United States Patent [19]

Sejbal et al.

[11] 3,952,780

[45] Apr. 27, 1976

[54] FABRIC STABILIZING APPARATUS DISPOSABLE AT THE INPUT OF THE WEFT BEAT-UP ZONE OF TRAVELLING-WAVE SHEDDING LOOMS

[75] Inventors: Dalibor Sejbal; Vitezslav Vasek; Zbynek Miks; Karel Prazak, all of Usti nad Orlici, Czechoslovakia

[73] Assignee: Vyzkumny ustav bavlsnarsky, Usti nad Orlici, Czechoslovakia

[22] Filed: Sept. 19, 1974

[21] Appl. No.: 507,566

[30] Foreign Application Priority Data

Oct. 24, 1973 Czechoslovakia ..... 7316-73

[52] U.S. Cl. ..... 139/291 R; 139/436; 139/292

[51] Int. Cl.[2] ..... D03D 49/00; D03D 47/26; D03J 1/22

[58] Field of Search ..... 139/291 R, 292–298, 139/12, 188 R

[56] References Cited

UNITED STATES PATENTS

| | | | |
|---|---|---|---|
| 1,052,417 | 2/1913 | Jackson | 139/291 R |
| 1,520,434 | 12/1924 | Paschall | 139/291 R |
| 3,362,436 | 1/1968 | Fend | 139/12 |
| 3,426,807 | 2/1969 | Pfarrwaller | 139/294 X |
| 3,621,886 | 11/1971 | Van Mullekom | 139/292 |
| 3,705,605 | 12/1972 | Titov | 139/12 |
| 3,771,573 | 11/1973 | Horn et al. | 139/294 |

FOREIGN PATENTS OR APPLICATIONS

| | | | |
|---|---|---|---|
| 134,864 | 2/1880 | France | 139/291 R |
| 1,269 | 1866 | United Kingdom | 139/291 R |
| 7,550 | 1886 | United Kingdom | 139/291 R |

*Primary Examiner*—James Kee Chi

[57] ABSTRACT

Apparatus for stabilizing a fabric in the travelling-wave shedding looms in a zone thereof where the weft is beaten up by beating-up projections of the disc of a rotary reed. The apparatus comprises means forming a stabilization slot, and a deflection rail downstream of said means, the top portion of said deflection rail lying above the level of the weaving plane, the means forming the stabilization slot including an upper delimitation rail having a lower edge and fixed on a continuous crossbar along the weaving plane, and a lower rail, the upper delimitation rail being an elastic stabilizing strip secured at its upper edge to the crossbar. The stabilizing strip is disposed generally above the rotary reed at the input portion of the said zone wherein the weft is beaten up, the stabilizing strip having its lower edge disposed above and resiliently engaging the upper shed warp ends and the outer circumferential edges of the discs of the rotary reed at the intersection of the upper shed warp ends with the outermost disc periphery circle downstream of the fabric fell, whereby the stabilizing strip prevents the warp threads of the upper shed sheet from being lifted by the outer circumferential edges of the disc of the rotary reed at the intersection of the upper shed warp ends with the outermost disc periphery circle downstream of the fabric fell, whereby the stabilizing strip prevents the warp threads of the upper shed sheet from being lifted by the outer circumferential edges of the discs of the rotary reed penetrating through said threads of the upper shed sheet.

9 Claims, 4 Drawing Figures

FABRIC STABILIZING APPARATUS DISPOSABLE AT THE INPUT OF THE WEFT BEAT-UP ZONE OF TRAVELLING-WAVE SHEDDING LOOMS

The present invention relates to an apparatus for stabilizing a fabric in travelling-wave shedding looms in a zone thereof where the weft is beaten up by beating-up projections on the discs of a rotary reed.

One of the problems encountered in the operation of travelling-wave shedding looms where weft threads woven in along the whole warp width are successively beaten up to the fabric fell by beating-up projections on discs of a rotary reed under a permanent tension prevailing in the warp/fabric system, consists in a tendency of the fabric fell to ascend or climb onto the rotary reed, since said fabric fell is in steady motion. Consequently, failures occasionally arise which impair the continuity of the weaving operation and the resulting fabric quality. Such a problem has been partly eliminated by a prior apparatus in which the fabric, immediately after the weft beat-up is caused to pass through a stabilizing slot or gap where-upon it is deflected beyond the weaving plane as it proceeds in its advance. Such a stabilizing slot or gap is formed with the edge of a stabilizing strip or upper delimitation supported by a continuous cross bar between a pair of selvage temples, and with a lower rail or strip, the former being followed by a deflection rail or deflecting strip of which the top portion is disposed beyond the weaving plane. Although the said prior arrangement has contributed to a substantial improvement in the process of continuous weaving, it has not solved the problem of the tendering of the fabric fell to climb onto the reed in its entirety. In this case, the first named stabilizing strip is formed by a rigid plate the edge of which is disposed adjacent the warp threads of the upper weaving shed with a certain play relative only to the maximum imaginary circle circumscribing the peaks of the beaten-up projections of the discs of the rotary reed. Since the entire outer circumferential edge of the discs is shaped, a relatively considerable part of the threads of the upper warp sheet remains without any control.

Thus, for instance, in another well-known apparatus, each disc has, on the one hand, a basic circumferential edge forming a circle substantially concentric with the bore provided for the disc shaft, and, on the other hand, beating-up projections merging into said basic outer edge, said beating-up projections forming a curve the distance of which from the center of the disc increases, in a direction opposite to the rotation thereof, faster than linearly. This curvilinear part of the projection is referred to herein as the beating-up edge. However, the peak of each of the beating-up projections is relatively considerably spaced apart from the basic circumferential edge of the disc and since the lower edge of the afore-mentioned stabilizing strip has to be adjusted, as herein above set forth, in dependence upon the circle circumscribing the peaks of the beating-up projections, the zone between the fabric fell or between said lower edge of the stabilizing strip and the theoretical region in which the warp threads of the upper shed are penetrated by the basic circumferential edges of the discs, when viewed from the side, remains without control. This free or uncontrolled section of the warp-/fabric system of which vertical lift is unlimited, tends to ascend, over the whole warp width, onto the rotary reed, by virtue of the increased tension occurring particularly when weaving a fabric with dense weft setting. This situation is responsible for many failures encountered in operation, such as, for example, slipping of some warp threads from one clearance between the discs into another one, which unfavorably affects the continuity of the weaving process and reduces the quality of the final woven product.

To eliminate the drawbacks of prior art as hereinbefore set forth, it is an object of the present invention to provide a control in the zone of the warp fabric system up to the line along which the warp threads of the upper shed are penetrated by the outer circumferential edges of the discs of the rotary reed, so as to stabilize the fabric in the zone of beating up the weft thread by the beating-up projections of said discs.

According to the invention, the aforesaid problem has been solved in that the stabilizing strip plate adapted to prevent the warp threads of the upper shed from being lifted by outer circumferential edges of the discs of the rotary reed penetrating through said threads, is constituted by an elastic plate the lower edge of which resiliently engages said outer circumferential edges of the discs of the rotary reed in the zone where the weft thread is beaten up to the fell of the fabric.

The stabilizing strip plate can be embodied as a spring steel plate, or a rubber plate, or a plate made of plastic having appropriate characteristics.

In accordance with a preferred embodiment of the invention, the lower edge of the stabilizing strip plate can be provided with a layer of a slippery material applied thereto, for instance, by plating with a Schoop spray gun or cementing, or formed by a separate strip of such material.

The stabilizing strip plate can be either continuous or, preferably, divided into longitudinal sections.

The merits of the apparatus for stabilizing the warp fabric system according to the present invention consists in that it has substantially contributed to the reduction of failure in the weft beat-up zone and to the enhancement of the continuity of the weaving process. Furthermore, the invention enables the quality of fabrics, especially those having relatively dense weft settings, to be substantially improved.

In order that the invention may be better understood and put into practice, some preferred embodiments thereof will be now described with reference to the accompanying schematic drawings which, however, are not intended to limit in any way the scope of the invention to the afore-mentioned exemplary embodiments.

Since the construction proper of travelling-wave shedding looms has been known and disclosed in several previous patents, the description thereof is limited here to some exemplary embodiments according to the present invention.

Figure 1:
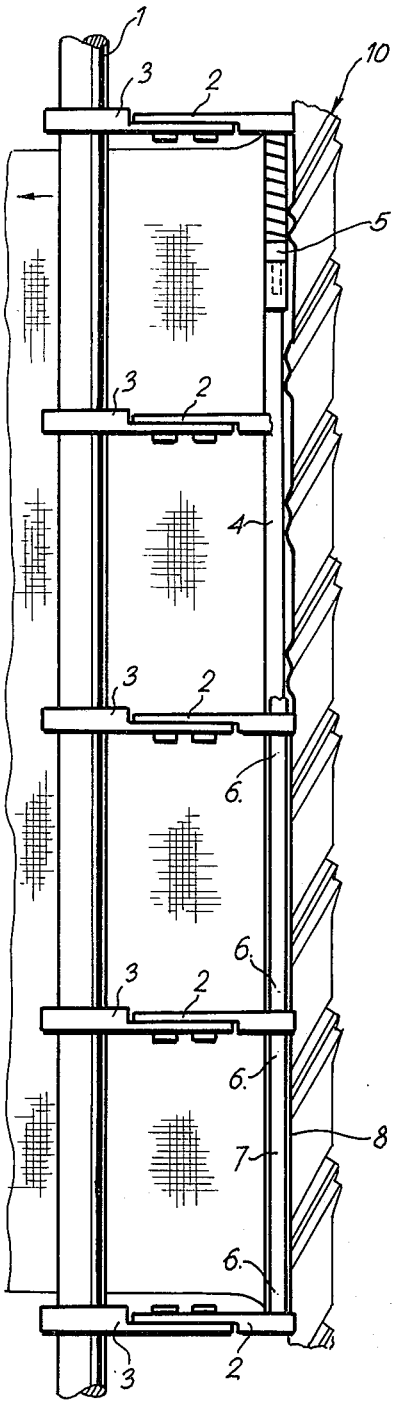
FIG. 1 is a fragmentary top view showing a cross beam supporting a continuous bar with a stabilizing strip plate in the weft beat-up zone.
Figure 2:
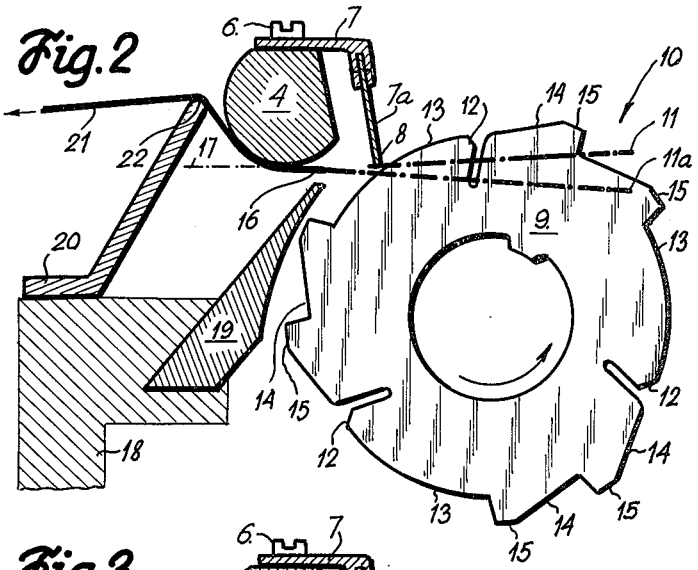
FIG. 2 is a cross-sectional view of the rotary reed together with the continuous bar and the stabilizing strip plate disposed in its basic position relative to the basic circumferential edge of the disc.
Figure 3:
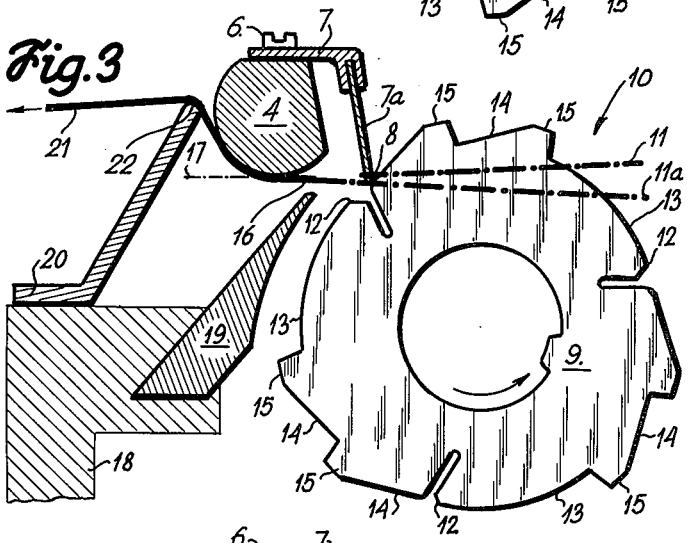
FIG. 3 is a view similar to FIG. 2, wherein the stabilizing strip plate begins to be engaged by the beating-up edge of the beating-up projection.
Figure 4:
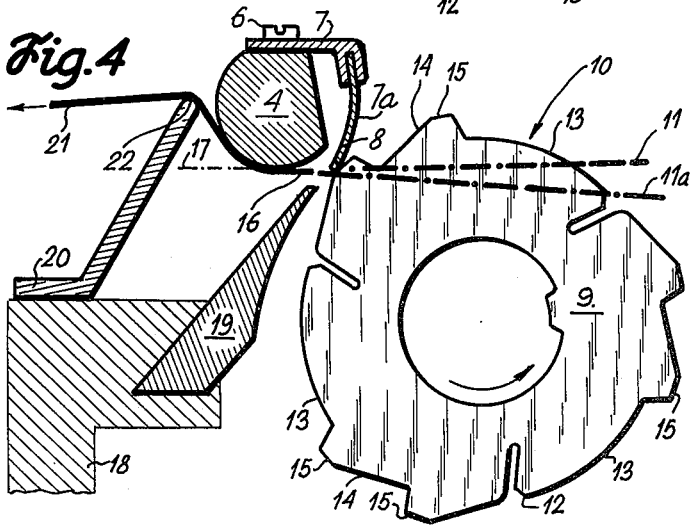
FIG. 4 is a view similar to FIGS. 2 and 3, wherein stabilizing strip plate is in its position on top of the respective beating-up projections at the instant of beating-up the weft to the fabric fell.

As it can be seen in FIG. 1, the machine frame (not shown) carries a stationary rigid cross beam 1 having sleeves 3 thereon, to which holders 2 are adjustably affixed. The holders 2 support a continuous cross bar 4, at the extremities of which selvage temples 5 are mounted for rotation. Further, strip plate 7 is adjustably secured to the continuous bar 4 by means of screw 6, strip plate 7 carrying an upper delimitation rail in the form of an elastic stabilizing strip 7*a*. The lower edge 8 of said stabilizing strip 7*a* bears against outer circumferential edges 12 of discs 9 of a rotary reed 19 in the zone where said reed 10 beats up weft threads to the fabric fell 16. By its lower or separating edge 8 the strip 7*a* engages warp threads 11 of the upper shed so as to prevent them from being lifted by the outer circumferential edges 12 of discs 9 of the rotary reed 10 (FIG. 2) penetrating therethrough. The threads of the lower shed are shown at 11*a*. The outer circumferential edge 12 of each disc 9 of the rotary reed 10 consists of a basic circumferential edge 13, beating-up edges 14 and beating-up projections 15. The discs 9 are angularly offset relative to each other so that identical points on the particular discs, if connected by an imaginary curve, form a helix. The lower edge 8 of the stabilizing strip 7*a* bearing upon the outer circumferential edges 12 of the discs 9 follows the rotational motion of the latter and under the influence of said beating-up projections 15 forming a helix, performs a sinuous movement, since the beating-up edges 14 force said lower edge 8 of the stabilizing strip 7*a* against the fell 16 of the fabric 21 up to the beat-up point. When the edge of the beating-up projection 15 has passed the fell 16 of the fabric, the lower edge 8 of the stabilizing strip plate 7 returns, due to its elasticity, to the starting position. By virtue of said sinuous movement of the lower edge 8 taking place within the weaving plane 17, the fell of the fabric 16 is continuously and permanently prevented from being lifted by the rotary reed 10 in the region of action of the beating-up edge 14 and the beating-up projection 15 thereof up to the weft beat-up instant whereby the vertical limitation of the fabric formation in the respective zone is achieved.

The stabilizing strip 7*a* is preferably constituted by a spring steel strip or by an elastic plate made of rubber or plastic. The lower edge 8 of the stabilizing strip 7*a* is preferably provided with a layer of an appropriate slippery material to achieve a more intimate guiding of the lower edge 8 upon the outer circumferential edges 12 of the discs 9. The slippery layer can be applied by using various techniques, such as, for instance, by Schoop's plating, cementing and the like, or it can be formed by a separate strip of an appropriate rub-proof material, such as "Teflon" attached in a usual manner to the lower edge 8 of said strip 7*a*. The stabilizing strip 7*a* can be either made continuous to extend over the whole reed width of the machine, including the selvage temples, or, preferably, it can be divided in sections, which is particularly suitable in those cases where the imaginary helix lead of the beating-up projections 15 is too steep.

To complete the specification it is to be added that to an inner beam 18 of the machine frame (not shown) a lower rail or strip 19 and a vertically adjustable rear deflection strip 20 are fixedly attached as by screws. It is to be noted that the arrangement according to FIGS. 1 and 2 meets the requirement of fixing the continuous bar 4 together with the selvage temples 5 in the vertical position so as to determine by said position the weaving plane 17 of the machine. The forces arising due to a tension in the warp fabric system and acting upon the continuous bar 4 together with the selvage temples 5, are absorbed by the rigid cross beam 1 embedded in the machine frame. The lower strip 19 extending over the whole width of the rotary reed 10 in a depth of from one to 1.5 mm below the weaving plane 17 (determined by the position of the continuous bar 4) and at a minimum distance from the rotary reed 10, is to prevent, by its uppermost edge, the fabric fell 16 from being entrained down by the edge of the beating-up projections 15 of the rotary reed 10. The passage of woven fabric 21 from the edge of the beating-up projection 15 to a sand roller (not shown) is determined by the arrangement and the relative positions of the weaving plane 17 (given by the position of the continuous bar 4 together with the selvage temples 5) and the uppermost edge 22 of the strip 20. By this arrangement an optimum embracement of the continuous bar 4 and the selvage temple 5 by the fabric is achieved, such embracement being necessary for the correct operation of the needled rings of the selvage temples 5.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In an apparatus for stabilizing the fabric within the weft beat-up area in a travelling-wave shedding loom, wherein the beat-up is effected by means of a rotary reed, the apparatus having means forming a stabilization slot, and a deflection rail downstream of said means, the top portion of said deflection rail lying above the level of the weaving plane, the means forming the stabilization slot including an upper delimitation rail having a lower edge and fixed on a continuous crossbar along the weaving plane, and a lower rail, the improvement wherein the upper delimitation rail is an elastic stabilizing strip secured at its upper edge to the crossbar, the elastic stabilizing strip being disposed generally above the rotary reed at the input portion of the said zone wherein the weft is beaten up, the stabilizing strip having its lower edge disposed above and resiliently engaging the upper shed warp ends and the outer circumferential edges of the discs of the rotary reed at the intersection of the upper shed warp ends with the outermost disc periphery circle downstream of the fabric fell, whereby the stabilizing strip prevents the warp threads of the upper shed sheet from being lifted owing to the tension of the warp threads and of the woven fabric produced in the front edge zone over the outer circumferential edges of the rotary reed.

2. Apparatus as claimed in claim 1, wherein the upper and lower rails are supported on the frame of the loom.

3. Apparatus as claimed in claim 2, wherein the continuous cross bar is supported on the frame of the loom.

4. Apparatus as claimed in claim 1, wherein the elastic stabilizing strip is formed by a spring steel sheet.

5. Apparatus as claimed in claim 1, wherein the elastic stabilizing strip is formed by a rubber plate.

6. Apparatus as claimed in claim 1, wherein the elastic stabilizing strip is formed by a plastic plate.

7. Apparatus as claimed in claim 1, wherein the lower edge of said elastic stabilizing strip is provided with a coating layer of a slippery material.

8. Apparatus as claimed in claim 1 wherein the elastic stabilizing strip extends continuously over the whole width of the loom.

9. Apparatus as claimed in claim 1, wherein the elastic stabilizing strip is divided into aligned longitudinal sections extending along the width of the loom.

* * * * *